United States Patent [19]

Ehmen

[11] 4,286,810

[45] Sep. 1, 1981

[54] MANUALLY OPERABLE LATCHING DEVICE

[76] Inventor: Thomas J. Ehmen, 1200 W. 8th Ave., Milan, Ill. 61264

[21] Appl. No.: 45,601

[22] Filed: Jun. 5, 1979

[51] Int. Cl.[3] ..... E05C 1/04

[52] U.S. Cl. ..... 292/67; 292/175; 292/DIG. 30; 292/DIG. 60

[58] Field of Search ..... 292/DIG. 30, DIG. 46, 292/DIG. 60, 63, 67, 69, 175

[56] References Cited

U.S. PATENT DOCUMENTS

| | | | |
|---|---|---|---|
| 757,464 | 4/1904 | Immell . | |
| 1,100,647 | 6/1914 | Baumann | 292/63 |
| 1,262,054 | 4/1918 | Johnson et al. | 292/175 |
| 1,448,642 | 3/1923 | Tomlinson | 292/175 X |
| 1,628,502 | 5/1927 | Letzau . | |
| 1,689,101 | 10/1928 | Beck . | |
| 1,928,734 | 10/1933 | Nelson | 292/67 X |
| 2,521,796 | 9/1950 | Kennedy | 292/67 |
| 2,593,247 | 4/1952 | Benteman | 280/33.15 |
| 2,788,067 | 4/1957 | Pawlak | 160/121 |
| 3,117,820 | 1/1964 | Toland et al. | 298/38 |
| 3,583,738 | 6/1971 | Uphoff | 292/67 |
| 3,608,957 | 9/1971 | Maneck | 296/146 |
| 3,713,690 | 1/1973 | Knothe et al. | 296/146 |
| 3,819,228 | 6/1974 | Cornacchia . | |

*Primary Examiner*—Richard E. Moore

*Attorney, Agent, or Firm*—Neuman, Williams, Anderson & Olson

[57] ABSTRACT

A manually operable latching device for use in securing a truck door in the open position during the loading and unloading process. The latching device comprises a cantilevered latching plate affixed to a truck trailer door and a pinning assembly secured to the frame of the truck at a location substantially adjacent the plate when the door is in the open position. The pinning assembly comprises a bushing bracket, a U-shaped rod moveably mounted within the bracket, a safety stop plate, and a spring attached to one end of the rod for exerting a compressive force between the rod and the bracket when the rod is moved relative to the bracket. The other end of the rod positively engages the plate to secure the door in the open position.

1 Claim, 3 Drawing Figures

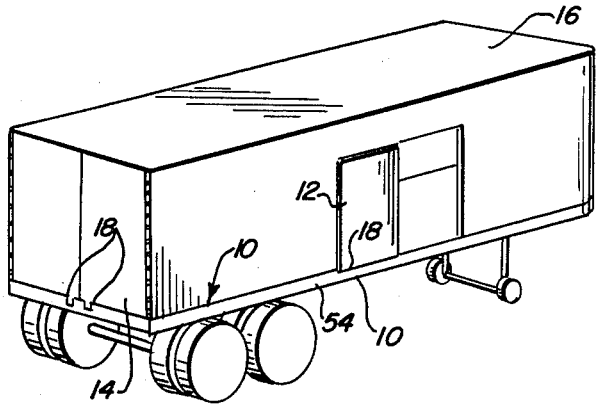
FIG. 1
FIG. 2
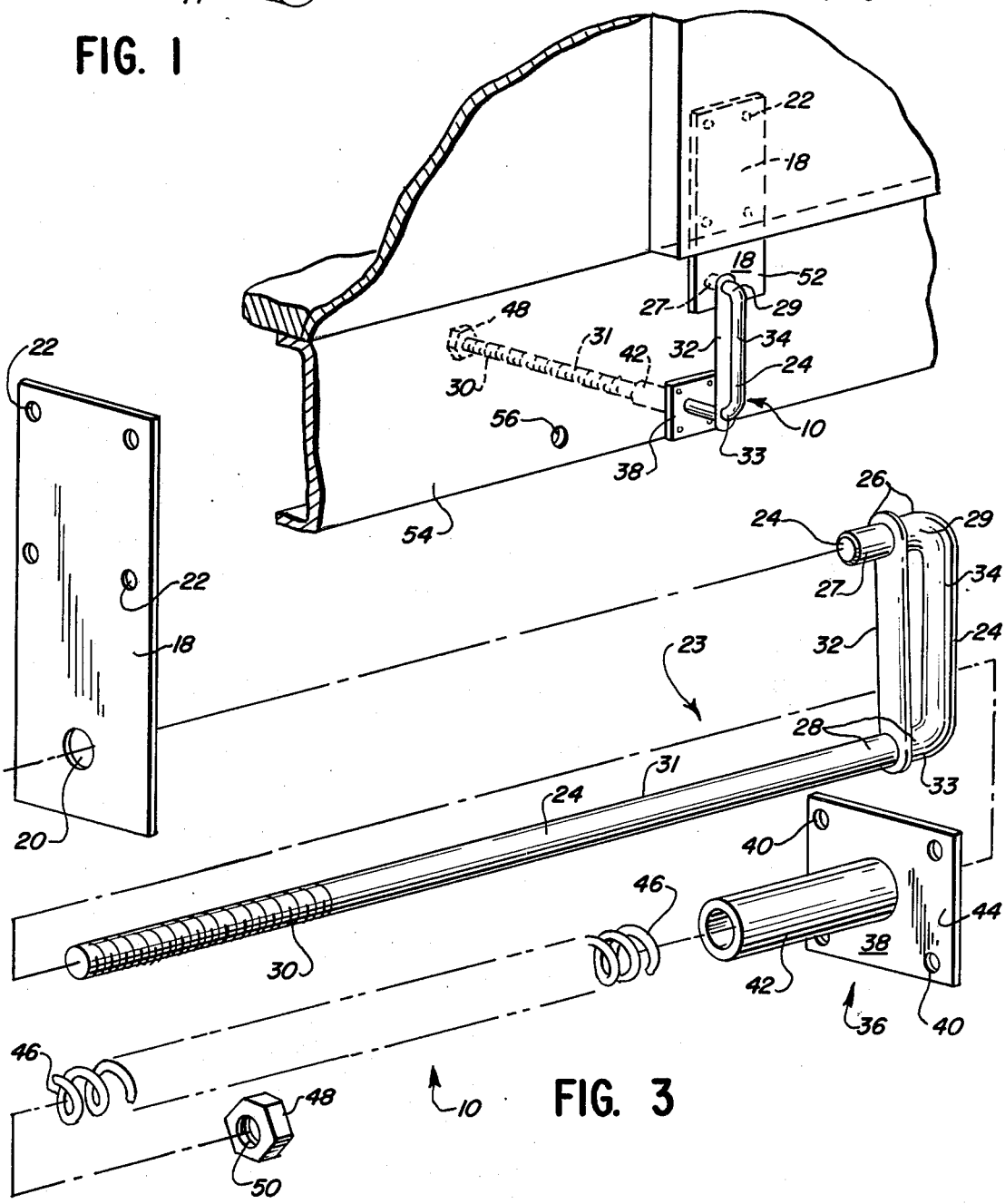
FIG. 3

MANUALLY OPERABLE LATCHING DEVICE

FIELD OF THE INVENTION

This invention relates to latching devices for use in securing a truck trailer or semi-trailer door in an open position while it is being loaded or unloaded. This application is related to my application Ser. No. 630,420, filed Nov. 10, 1975, now abandoned.

BACKGROUND OF THE INVENTION

There is a need in the trucking industry for a safe and easy to operate mechanism for holding the trailer door in the open position while cargo is being handled. Such a device must be compatible with both side and rear loading trailers and capable of operating efficiently with sliding, folding, and rolling type doors. The latching mechanism must be simple and quick to operate from outside the trailer as opposed to from inside or underneath the trailer. Furthermore, the latching device must not create unsightly, interfering, and unlawful protrusions of components beyond the normal dimensional characteristics of the trailer.

The most common door securing device which is used on truck trailers or semi-trailers is a simple hook and eye mechanism for holding the trailer doors in an open position. In order for the hook and eye device to practically operate, any type door using it must have sufficient play that the door is capable of some movement even when latched. This allows the hook and eye to be engaged or disengaged. These hook and eye devices have several problems which render them both inefficient and dangerous. In these simple devices, the hook is frequently jarred from the eye by sudden movement of the trailer during loading or unloading. The trailer can be moved sufficiently to cause this undersirable result from the shifting of cargo, from a lift truck or worker boarding or unboarding, or simply from the wind. Even if the jarring force is not of sufficient magnitude to disengage the hook and eye directly, a sufficient momentum can be built up due to the play necessary for originally engaging the hook and eye that shears the hook portion of the hook and eye device. If the hook is sheared or the door is otherwise unexpectedly released, it has a tendency to return to the closed position. When the door is unexpectedly and suddenly returned to the closed position, personal injury or damage to property may result. Workers can be struck and seriously injured when a hook disengages the eye and the heavy trailer door closes upon them. Workers can have their arms or hands pinched or crushed when attempting to latch or unlatch the hook because this activity requires that the worker place his hand and arm between the heavy trailer door and the side of the trailer thereby exposing the worker to the danger of being pinned between door and trailer.

In addition to the possible personal injuries, equipment can be extensively damaged if it is struck by a released door during the loading or unloading of cargo. The cargo itself may be damaged or destroyed by colliding with an unlatched door. Additionally, whenever an accident occurs incident to the trailer door swinging shut, time is lost in attending to injuries, making repairs, or replacing damaged goods or equipment. Of course, the loss of time is expensive and the potential of injury is demoralizing to a crew of workers.

The present invention cures the safety deficiencies of the hook and eye latching devices, and has several other desirable features. The latching device of this invention provides a positive latch that eliminates the play between the door and the latching mechanism when the door is being held in the open position. The latching device of the present invention withstands shearing forces, and it does not disengage when the truck is jarred during loading or unloading. The device of this invention does not require that the user expose himself to danger while engaging or disengaging the latching mechanism.

It is an object of the present invention to provide a latching device for securing doors in an open position which is simply and quickly operated.

A further object of the present invention is to provide a positive latching mechanism that remains latched when inadvertently jarred.

Another object of the present invention is to provide a positive latching device able to withstand shearing forces.

An additional object of the present invention is to provide a positive latching device that is safely operated from outside the trailer rather than from inside, underneath, or between parts of the truck trailer.

Still another object of the present invention is to provide a positive latching device that does not excessively or unlawfully protrude from the normal dimensional characteristics of a truck trailer or interfere with operation of the trailer, loading, or unloading.

Finally, an object of the present invention is to provide a positive latching device compatible for use on all types of trailer doors which is simple and relatively inexpensive to construct or manufacture and easy to install.

Other objects and advantages of the invention will become apparent upon reading the following detailed description and appending claims, and upon reference to the accompanying drawings.

SUMMARY OF THE INVENTION

The door latching device of this invention comprises a door latch plate which is secured in a cantilevered manner to the trailer door and a pinning assembly which is secured to the body or frame of the trailer at a location adjacent to the plate when the door is in the open position. The latch plate has a latch aperture in the portion of the plate extending beyond the edge of the door. The pinning assembly comprises a bushing bracket which is affixed to and channeled through the trailer body or frame, a nut, a compression coil spring, a stop plate, and a U-shaped rod having a first and second end portion and an intermediate portion. The intermediate portion of the rod forms a handle connecting the first and second end portions. The stop plate is positioned approximately midway along the length of the first end portion of the U-shaped rod thereby dividing the first end portion into a first free end section and a first captive segment. The free end section fits through the aperture in the latch plate until the stop plate abuts the latch plate. The stop plate likewise divides the second end portion into a second free end section and a second captive segment. The first and second captive segments of the first and second end portions provide an offset between the stop plate and the intermediate handle portion. The second free end section of the U-shaped rod is threaded to receive the nut. This second free end section of the rod is longer than the first free end segment and is inserted through the bushing bracket and extends beyond the bushing. The compression spring is disposed about the second free end segment of the rod. The spring is secured about this protruding end by threading the nut onto the threads of the second free end segment of the U-shaped rod. The second end portion of the rod is free to rotate about or to traverse under tension from the compression coil spring along its longitudinal axis.

The latching mechanism provides a positive lock for securing a door in the open position. To operate the latching device the user places the trailer door in the open position, grasps the handle portion of the U-shaped rod, retracts it along its longitudinal axis compressing the spring, and releases it such that the first free end segment of the first end portion extends through the latch plate aperture until the stop plate abuts the latch plate. After the handle is released and the first free end engages the latch plate aperture, the spring expands and withdraws the rod thereby forcing the trailer door against the trailer frame. The user's hand or arm never comes between the trailer and the opened door, and since the captive segments provide an offset between the latch plate and the intermediate portion of the rod, the user's hand is protected thereby reducing the likelihood of injury during latching. The door remains positively latched in the open position thereby preventing the injuries or damage attendant to the door unexpectedly closing. To release and close the door, a user simply grasps the handle and retracts it compressing the spring and disengaging the first free end from the latch plate aperture. The user then releases the handle so that the first free end does not re-engage the latch plate aperture.

When the latching device is not being used to secure an open door, it retracts out of the way, avoiding unsightly, interfering, and unlawful protrusions from the trailer. A bore is provided in the trailer body or frame so that by rotating the handle the user aligns the first free end with the bore in the trailer frame and by releasing the handle, the first free end enters the bore until the stop plate abuts the trailer frame surrounding the bore preventing further rotation of the handle. The captive segments of the first and second end portions provide an offset between the frame and the intermediate handle portion so that the handle is not drawn into contact with the trailer frame and is thereby easy for the user to grasp. The only portion that protrudes outside the trailer is the small, yet easy to grasp handle. All other portions of the latching device, except the latching plate which is affixed to the door and the stop plate, are concealed beneath the bottom of the trailer.

BRIEF DESCRIPTION OF THE DRAWINGS

For a more complete understanding of this invention, reference should now be had to the embodiments illustrated in greater detail in the accompanying drawings and described below. In the drawings:

FIG. 1 is a perspective view of a trailer showing the position of a pair of door latching devices for use with both side and rear trailer doors;

FIG. 2 is a fragmentary perspective view of the side and underframe of a trailer showing the door latching device securing a door in the open position;

FIG. 3 is an exploded perspective view of the door latching device showing each of the component parts of the device and the relative construction thereof.

DESCRIPTION OF THE PREFERRED EMBODIMENT

Referring now to the drawings, a manually operable door latching device 10 is used to positively secure in the open position many types of doors such as a side door 12 or a rear door 14 of a truck trailer or semi-trailer 16. The word trailer and the reference number 16 are used to describe the vehicle in FIG. 1, however, it is to be understood that the latching device 10 may be used to positively secure in an open position many types of doors for many types of vehicles.

As shown principally in FIG. 3, the latching device 10 comprises a latch plate 18 and a pinning assembly 23. The latch plate 18 has a latch aperture 20 and a plurality of mounting holes 22. The pinning assembly 23 comprises a U-shaped rod 24 having a first end segment 26 which is substantially parallel to a longer second end segment 28 and which is substantially perpendicular to an intermediate segment or handle 34, a stop plate 32, a sleeve or bushing bracket 36, a compression coil spring 46; and a nut 48. The second end segment 28 is longer than the first end segment 26 and has male threads 30. A stop plate 32 is affixed to and extends between both end segments 26 and 28 and is substantially parallel to the handle portion 34 of rod 24. The stop plate 32 is disposed approximately midway along the length of the first end segment 26 thereby dividing it into a first free end section 27 and a first captive segment 29 and dividing the second end segment 28 into a second free end section 31 and a second captive segment 33. The free end sections 27 and 31 protrude outwardly from the stop plate 32, while the captive segments 29 and 33 provide an offset between the stop plate 32 and the handle 34. The bushing bracket 36 comprises a bracket plate 38 with a plurality of mounting bores 40 and a bushing 42 which is affixed to the inside face 44 of the bracket plate 38. The compression spring 46 has an inside diameter greater than the diameter of the U-shaped rod 24 such that it fits about the second free end section 31 of said rod 24. The nut 48 has female threads 50 to accept the male threads 30 of the second end segment 28 of the rod 24 for capturing the spring 46 between the nut 48 and the bushing bracket 36. It is to be understood that the nut 48 and thread 30 assembly for capturing the spring 46 is a preferred embodiment, other means for directing a compressive force about the longitudinal axis of long end 28 may also be used.

The latch plate 18 is mounted upon the outside of a door near its bottom edge using the mounting holes 22 and bolts, rivets, or other suitable means, as shown, for example, on the side door 12 of FIG. 2. The latch plate 18 is mounted such that a cantilevered portion 52 with the latch aperture 20 extends below the door 12. The bushing bracket 36 is mounted upon and through the underframe member 54 using the mounting bores 40 and bolts, rivets, or other suitable means. The bushing bracket 36 is positioned such that the longitudinal axis of the bushing 42 is adjacent to and aligns substantially vertical with the center of the latch plate aperture 20 when the door 12 is fully open. Said bushing 42 has an inner diameter slightly larger than the diameter of second end segment 28 of rod 24 such that when the second end segment 28 is inserted through bushing 42 it is capable of rotating freely without any appreciable transverse play. The compression coil spring 46 is slidably mounted around the second free end section 31 of the second end segment 28 which extends through bushing 42 and is captured by threading the nut 48 onto the second end segment 28.

To operate the latching device 10 a user opens the door 12 fully, grasps the handle 34 and retracts the rod 24 along the longitudinal axis of its second end segment 28. This retraction compresses the spring 46 which is captured between the nut 48 and the bushing 42. The user then rotates the handle 34 about the longitudinal axis of the second end segment 28 until the first free end section 27 aligns with the latch plate aperture 20, thereupon, he releases his longitudinal pulling force and the compressed spring 46 expands drawing the first free end section 27 well through the aperture 20 and against the underframe member 54. The stop plate 32 abuts the latch plate 18 thereby eliminating the play in the opened door 12. The force needed to extract the rod 24 is adjustable by tightening or loosening the nut 48.

When the latching device 10 secures a door 12 in the open position, as described above, the first free end section 27 does not release the door 12 unless a sufficient force along the longitudinal axis of the second end segment 28 draws the rod 24 out of the latch aperture 20. Since the compressive force created by the spring 46 draws the stop plate 32 tight against the latch plate 18, the compression spring 46 and stop plate 32 eliminate the play in the door 12, thereby eliminating the possibility that the door will build up sufficient momentum to exert a shearing force. In addition, U-shaped rod 24 is of sufficient diameter and is constructed of a material, e.g., steel, that is capable of withstanding shearing forces in any transverse direction. These features combine to provide the safety advantages of a positive latch not provided by the hook and eye latching mechanism.

To release the door 12 and place the handle 34 safely out of the way, a user grasps the handle 34 and pulls until the first free end section 27 disengages the latch aperture 20. The user then rotates the handle 34 about the longitudinal axis of the second end segment 28 until the first free end section 27 aligns with a bore 56 which is provided in the underframe 54. By reducing the pulling force, the first free end section 27 is slowly drawn through bore 56 by the expanding spring 46 until the stop plate 32 abuts the bracket plate 38. The stop plate 32 provides an additional safety advantage because it shields the user's hand from being pinched or crushed between the pinning assembly 23 and the door 12 or underframe 54. If a stop plate 32 or some similar means to abut the bracket plate 38 is not used, the rod 24 will retract until the handle 34 abuts the underframe 54. Most of the rod 24 is thus concealed beneath the trailer 16 and behind the underframe 54. Only the handle 34 extending outward from the stop plate 32 and conveniently positioned for the subsequent use of the latching device 10 is exposed to view.

An alternative embodiment of the latching device 10 has a stop plate 32 which is affixed about the second end segment 28 only limiting the perpendicular displacement of second end segment 28 into the bushing bracket 36. Still another embodiment has a stop plate 32 affixed to the first end segment 26 only. This embodiment limits the movement of the door when the stop plate 32 abuts the latch plate 18.

While a particular embodiment of the invention has been shown, it is understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

What is claimed is:

1. A manually operable latching device for use on a vehicle having a movable cargo door for safely securing said door in an open position comprising:

a latch plate secured to said movable door, said latch plate having a cantilevered portion extending beyond said movable door and said cantilevered portion having an aperture; and a pinning assembly capable of withstanding shearing forces applied transverse to its longitudinal axis, said pinning assembly secured to said vehicle at a location to facilitate the latching of said pinning assembly with said aperture of said latch plate when said movable door is in an open position, and to facilitate concealment of portions of said pinning assembly to reduce the extent of protuding portions thereof and comprising:

a U-shaped rod having an intermediate segment, a first end segment and a second end segment, said second end segment having threads, said intermediate segment being substantially normal to said first and second end segments and said intermediate segment serving as a handle enabling said first end segment to engage and disengage from said latch plate;

a sleeve, secured to said vehicle, accepting said second end segment of said rod in longitudinal sliding engagement and to restrict the movement of said rod to displacement substantially perpendicular to the plane of said movable door and to rotation about the longitudinal axis of the sleeve;

a compression means connected to said rod for preventing movement of said rod relative to said sleeve until said rod is manually displaced for engaging or disengaging from said latch plate;

a nut engaging said threaded second end segment, said nut being movable along said threaded second end segment for adjusting the compressive force of said compression means; and, a safety stop means fixed to at least one of said end segments and in spaced relationship to said intermediate segment for limiting the perpendicular displacement of said U-shaped rod and for providing an offset between said safety stop means and said intermediate segment.

* * * * *